US009055826B2

(12) United States Patent
Curts et al.

(10) Patent No.: US 9,055,826 B2
(45) Date of Patent: Jun. 16, 2015

(54) WATER SPORTS EQUIPMENT STORAGE RACK FOR A BOAT

(71) Applicants: MasterCraft Boat Company, LLC, Vonore, TN (US); Gere Marie Corporation, Lake Zurich, IL (US)

(72) Inventors: Chadrick Curts, Lenoir City, TN (US); James Schultz, Lake Zurich, IL (US); Gregory Mackall, Wauconda, IL (US)

(73) Assignees: MASTERCRAFT BOAT COMPANY, LLC, Vonore, TN (US); GERE MARIE CORPORATION, Lake Zurich, IL (US)

( * ) Notice: Subject to any disclaimer, the term of this patent is extended or adjusted under 35 U.S.C. 154(b) by 95 days.

(21) Appl. No.: 14/051,870

(22) Filed: Oct. 11, 2013

(65) Prior Publication Data

US 2015/0101525 A1 Apr. 16, 2015

(51) Int. Cl.
*B63B 17/00* (2006.01)
*A47F 7/00* (2006.01)

(52) U.S. Cl.
CPC ..... *A47F 7/0021* (2013.01); *A47F 7/00* (2013.01); *B63B 17/00* (2013.01)

(58) Field of Classification Search
CPC ..... B63B 17/00; B63B 25/24; B63B 25/28; B63B 35/00; B63B 35/85; B63B 69/00; B63B 2017/00; B63B 2017/0009; B63B 2017/0054; B63B 2025/24; B63B 2025/28; B60R 7/00; B60R 9/00; B60R 11/00; A47F 7/00; A47F 7/0021
USPC ..... 114/343, 364, 382; 224/406, 558, 564, 224/571, 917.5
See application file for complete search history.

(56) References Cited

U.S. PATENT DOCUMENTS

| | | | | |
|---|---|---|---|---|
| 409,142 | A | 8/1889 | Dom | |
| 3,291,427 | A | 12/1966 | Hutchings | |
| 4,582,015 | A | 4/1986 | Hunter | |
| 4,863,082 | A | 9/1989 | Evans et al. | |
| 4,907,525 | A | 3/1990 | Schmidt | |
| 5,752,638 | A | 5/1998 | Meeks | |
| 5,826,908 | A | 10/1998 | McBride | |
| 5,906,304 | A | 5/1999 | Baldacchino | |
| 6,886,795 | B2 | 5/2005 | Schultz | |
| 8,025,194 | B2 * | 9/2011 | Jesewitz | 224/406 |
| 2005/0155999 | A1 | 7/2005 | Gasper | |
| 2006/0037527 | A1 * | 2/2006 | Aff | 114/364 |
| 2007/0062992 | A1 * | 3/2007 | Hepworth et al. | 224/406 |
| 2007/0209567 | A1 | 9/2007 | Fee et al. | |
| 2013/0037677 | A1 | 2/2013 | Bohanan et al. | |

* cited by examiner

*Primary Examiner* — Daniel V Venne
(74) *Attorney, Agent, or Firm* — Fitzpatrick, Cella, Harper & Scinto

(57) ABSTRACT

A rack for holding water sports equipment includes a substantially upright surface, an arm, a pedal, and a linkage between the pedal and the arm. The arm is configured to hold a piece of water sports equipment between the arm and the substantially upright surface. The arm is movable away from the substantially upright surface, against a force biasing the arm toward the substantially upright surface, to allow the piece of water sports equipment to be inserted or removed from between the arm and the substantially upright surface. The pedal is positioned and configured to be moved from a closed position to an open position by a force applied by a human foot and to return to the closed position when that force is removed. The pedal is directly or indirectly connected to the arm in order to move the arm away from the substantially upright surface when the pedal is moved from the closed position to the open position.

23 Claims, 7 Drawing Sheets

WATER SPORTS EQUIPMENT STORAGE RACK FOR A BOAT

FIELD OF THE INVENTION

This invention relates to an apparatus for storing water sports equipment on a boat.

BACKGROUND OF THE INVENTION

Boats are used to tow water sports performers such as water skiers, wakeboarders, wakesurfers, and the like. These water sports require the use of various equipment such as water skis, wakeboards, surfboards, and the like. When not in use, this equipment is often stored on the boat, preferably in racks or compartments. Preferably, these racks and compartments are designed to maximize the space onboard the boat and prevent the equipment from moving around while stored.

SUMMARY OF THE INVENTION

The present invention relates to rack for holding water sports equipment. The rack is especially suited for mounting along an interior wall of a boat.

In one aspect, the invention relates to a rack for holding water sports equipment. The rack includes, in main part, a substantially upright surface, an arm, and a pedal. The substantially upright surface is suitable for mounting along an interior wall of a boat. The arm opposes the substantially upright surface and is configured to hold a piece of water sports equipment between the arm and the substantially upright surface. The arm is movable away from the substantially upright surface, against a force biasing the arm toward the substantially upright surface, in order to allow the piece of water sports equipment to be inserted or removed from between the arm and the substantially upright surface. The pedal is movable between a closed position and an open position. The pedal is positioned and configured to be moved from the closed position to the open position by a force applied by a human foot and to return to the closed position when that force is removed. The pedal is directly or indirectly connected to the arm in order to move the arm away from the substantially upright surface when the pedal is moved from the closed position to the open position.

The rack preferably includes a linkage between the pedal and the arm that is configured to move the arm away from the substantially upright surface when the pedal is moved from the closed position to the open position. The rack preferably also includes a spring for biasing the arm toward the substantially upright surface.

The rack may include one or more additional arms. In one preferred embodiment, a second arm (i) is provided at the same height as, and spaced apart from, the first arm, (ii) opposes a second substantially upright surface, (iii) is configured to hold the piece of water sports equipment between the second arm and the second substantially upright surface, and (iv) is movable away from the second substantially upright surface, against a force biasing the second arm toward the substantially upright surface, in order to allow the piece of water sports equipment to be inserted or removed from between the second arm and the second substantially upright surface.

In another preferred embodiment, a second arm (i) is provided either above or below the first arm, (ii) opposes the substantially upright surface, (iii) is configured to hold a second piece of water sports equipment between the second arm and the substantially upright surface, and (iv) is movable away from the substantially upright surface, against a force biasing the second arm toward the substantially upright surface, in order to allow the second piece of water sports equipment to be inserted or removed from between the second arm and the substantially upright surface.

In another aspect, the invention relates to a boat. The boat includes a hull including a bow, a stern, and starboard and port sides. The boat also includes a rack, as described herein, for holding water sports equipment. The rack is mounted along an interior wall of the boat.

DETAILED DESCRIPTION OF THE PREFERRED EMBODIMENTS

Figure 1:
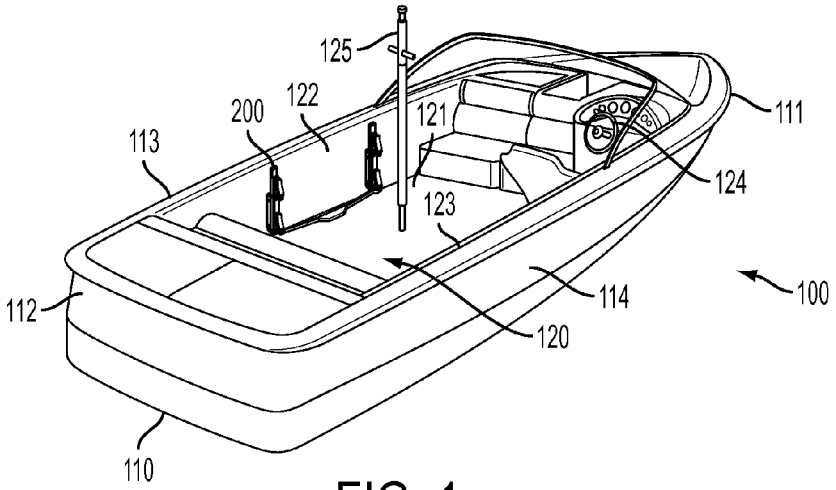
FIG. 1 shows a boat including a rack for holding water sports equipment according to a preferred embodiment of the invention.

FIG. 1 shows a boat 100 equipped with a rack 200 for holding water sports equipment in accordance with an exemplary preferred embodiment of the invention. The boat 100 includes a hull 110 with a bow 111, a stern 112, and port and starboard sides 113, 114. Collectively, the bow 111, the stern 112, and the port and starboard sides 113, 114 define an interior 120 of the boat 100. Within the boat's interior 120 are a floor 121 and port and starboard sidewalls 122, 123. Also within the boat's interior 120 is a control console 124 for operating the boat 100 and a ski pylon 125.

Figure 2:
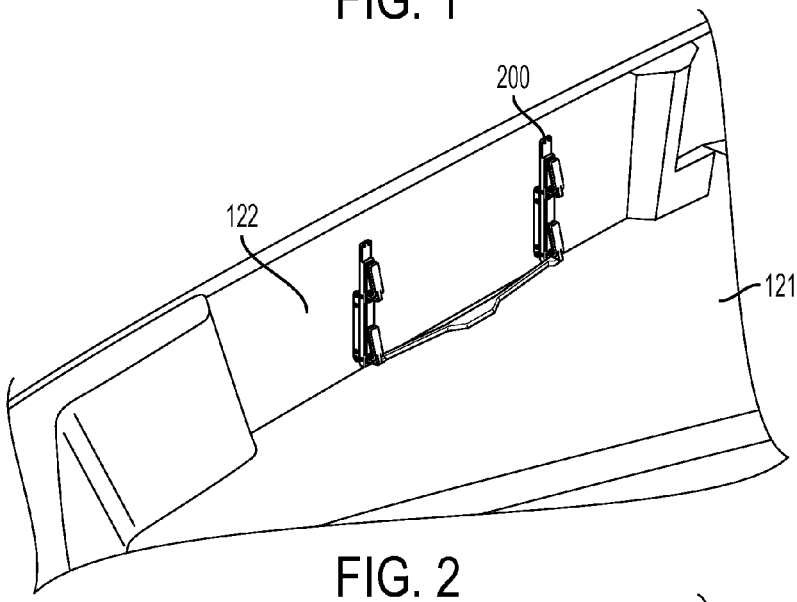
FIG. 2 is a close-up view of the rack of FIG. 1 mounted along the port sidewall of the boat.

FIG. 2 shows the rack 200 mounted along an interior wall of the boat 100. In this embodiment, the interior wall is the port sidewall 122. A preferred location for the rack is along either the port sidewall 122 or the starboard sidewall 123, aft of the control console 124. One of the benefits of this location is that there is enough room for the rack to hold a water ski, which may be about 70 inches long. Those skilled in the art will recognize that other locations within the boat may also be suitable, especially if the rack is configured to hold shorter pieces of water sports equipment. Those skilled in the art also will recognize that a boat may include multiple racks, for example, one along each of the port and starboard sidewalls 122, 123.

Figure 3:
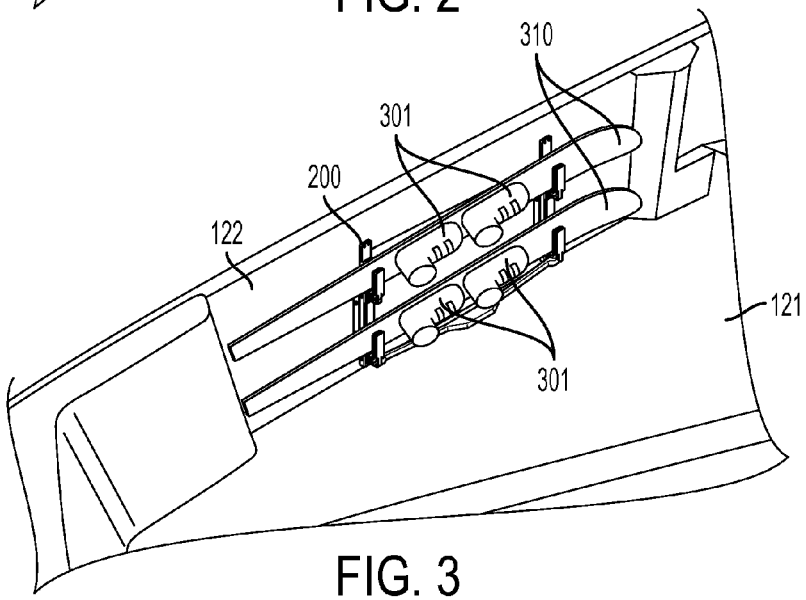
FIG. 3 shows the rack of FIG. 2 holding a pair of water skis.

The boat 100 shown in FIGS. 1 and 2 is capable of being used for water skiing and the rack is configured to hold a pair of water skis 310, as shown in FIG. 3. Those skilled in the art will recognize that the rack may be configured to hold other types of water sports equipment such as a wakeboard, a surfboard, and the like.

Figure 4:
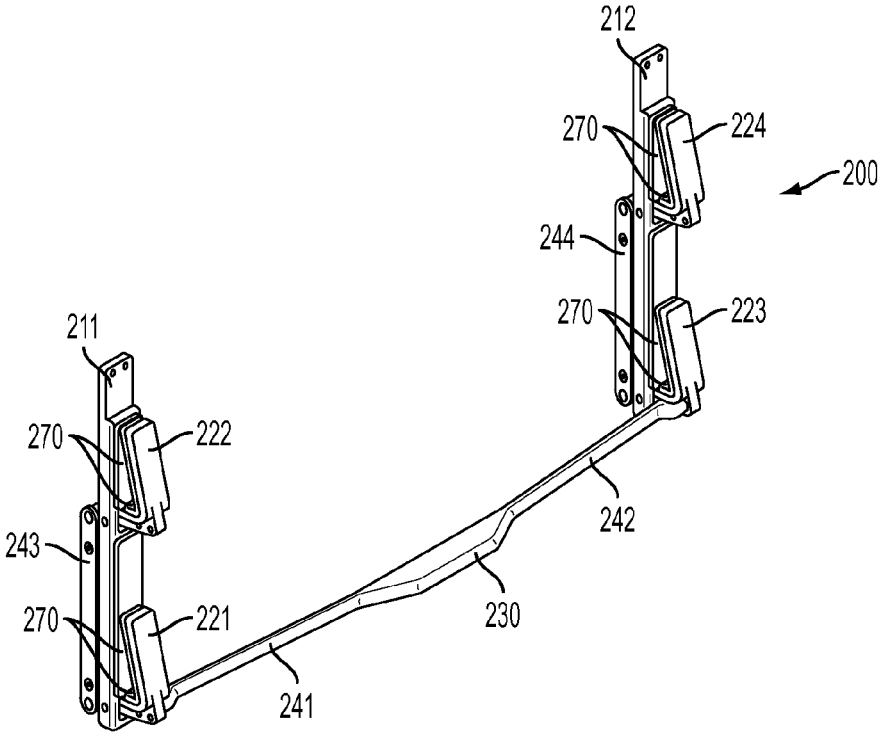
FIG. 4 is a detailed view of the rack shown in FIGS. 1-3.
Figure 6:
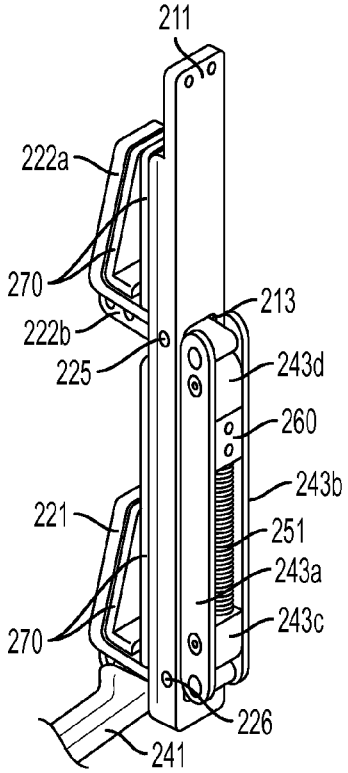
FIG. 6 shows the portion of the rack shown in FIG. 5 from a reverse angle.

FIG. 4 shows a preferred embodiment of the rack 200. The rack 200 includes substantially upright surfaces 211, 212, arms 221, 222, 223, 224, a pedal 230, and linkages 241, 242, 243, 244. Additionally, the rack may include springs 251 (as shown in FIG. 6) for biasing the arms 221, 222, 223, 224 toward the substantially upright surfaces 211, 212. Each arm 221, 222, 223, 224 is configured to hold a piece of water sports equipment between it and its opposing substantially upright surface 211, 212. Because the rack is designed to be used in a marine environment, the rack is preferably made of materials suitable for that environment. In the preferred embodiment, these materials are primarily corrosion-resistant metal alloys such as aluminum and stainless steel. Those skilled in the art will recognize that other suitable materials may be used including wood, plastic, or other metals.

In the preferred embodiment shown in FIG. 4, the substantially upright surfaces 211, 212 are elongated, rectangular bars capable of being mounted to an interior wall of the boat, for example, the port or starboard sidewall. The bars preferably are between about 1 inch to about 2 inches wide and made of aluminum. The substantially upright surfaces 211, 212 may be attached to the interior wall by any suitable means including, for example, screws, bolts, adhesives, and the like.

A substantially upright surface is one that is oriented more vertically than horizontally. Put another way, the substantially upright surfaces 211, 212 are positioned at an angle greater than about 45 degrees and less than about 135 degrees with respect to the floor 121. More preferably, they are positioned at an angle greater than about 75 degrees and less than about 105 degrees with respect to the floor 121. Most preferably, they are positioned at an angle of about 90 degrees with respect to the floor 121 and/or are parallel to the interior wall of the boat to which they are mounted.

The substantially upright surfaces are not limited to the geometry shown in the preferred embodiment. For example, the substantially upright surfaces may be rods, posts, or plates instead of bars. Similarly, a plurality of surfaces is not required, and a single flat plate or even the interior wall itself may serve as the substantially upright surface for multiple sets of arms. In choosing the geometry of the substantially upright surface, considerations include, among other things, that it be rigid enough to withstand a securing force imparted by the arms when holding a piece of water sports equipment against it and that it have sufficient surface area to hold the piece of water sports equipment.

The substantially upright surfaces 211, 212 may be lined with padding 270 to prevent damage to the water sports equipment. In the preferred embodiment, the substantially upright surface is lined with neoprene foam padding. The neoprene foam padding provides friction to secure the piece of water sports equipment and protects the piece of water sports equipment from damage. Neoprene foam padding is preferred because it holds up well in a marine environment.

Figure 5:
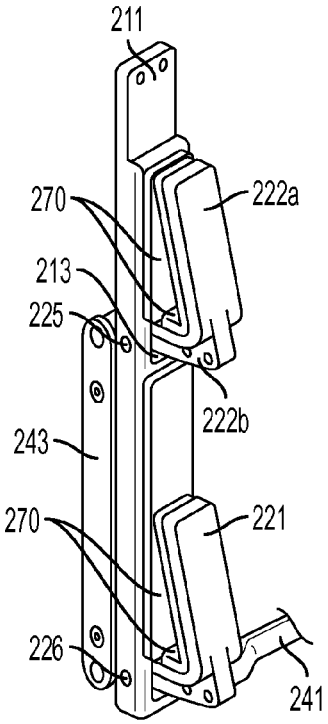
FIG. 5 is a detailed view of a portion of the rack shown in FIG. 4.

In the preferred embodiment shown in FIG. 4, the arms 221, 222, 223, 224 and the substantially upright surfaces 211, 212 are configured to hold a pair of water skis. In this embodiment, two arms 221, 222 and 223, 224 oppose each of the substantially upright surfaces 211, 212. One arm 222, 224 is positioned above the other arm 221, 223. The top two arms 222, 224 hold one ski and the bottom two arms 221, 223 hold another ski. (In the following description reference will be made to arm 222, but the description applies equally to each of the other arms 221, 223, 224.) As shown in FIGS. 5 and 6, each arm (e.g., 222) is substantially L-shaped with a vertical portion 222*a* and a horizontal portion 222*b*. In the preferred embodiment, the horizontal portion 222*b* of each arm extends through a slot 213 (best seen in FIG. 8) in the substantially upright surface 211. The horizontal portion 222*b* of the arm is attached by a pivotable connection 225 to either the substantially upright surface 211 or another member (not shown) that is fixed relative to the substantially upright surface 211. The arm 222 pivots about this pivotable connection 225 when moving away from or toward the substantially upright surface 211. In the preferred embodiment, the pivotable connection 225 comprises a bronze sleeve bearing and a stainless steel dowel pin. Those skilled in the art will recognize that other types of pivotable connections may be used as alternatives. As with the substantially upright surface, each arm may be lined with padding 270. Those skilled in the art will recognize that other arm shapes may be suitable for this invention, for example, a V-shaped arm may be used.

Figure 11:
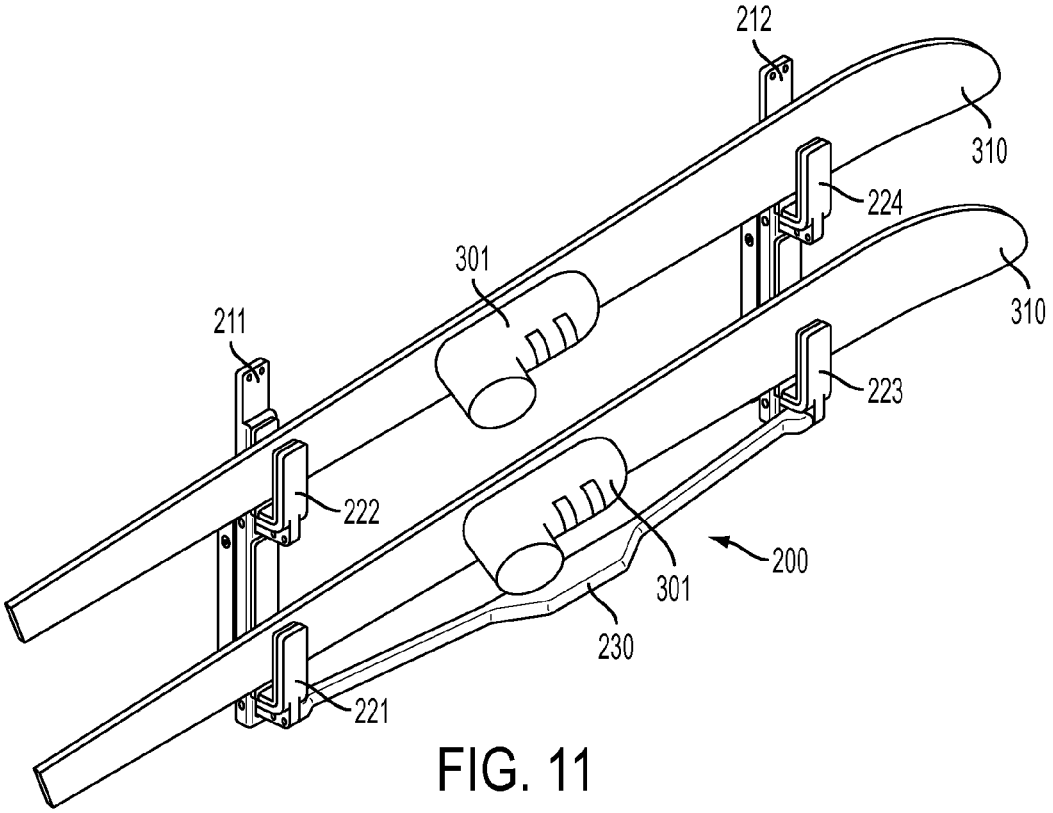
FIG. 11 shows the rack of FIG. 4 holding a pair of water skis.

In this preferred embodiment for holding skis 310, the corresponding pairs of arms 221, 223 and 222, 224 are located such that one arm 223, 224 is proximate the front of the ski 310 and the other arm 221, 222 is proximate the rear of the ski 310 when the ski is placed in the rack 200, as shown in FIG. 11. Preferably, corresponding pairs of arms 221, 223 and 222, 224 are spaced far enough apart to allow a boot 301 of the ski to fit between the arms, as shown in FIG. 11. More preferably, corresponding pairs of arms 221, 223 and 222, 224 are spaced far enough apart so that the two boots 301 on a slalom ski may be placed between the arms, as shown in FIG. 3. The arms 221, 222, 223, 224 preferably are positioned to hold different lengths of skis without the substantially upright surfaces or arms contacting the fins that typically are located on the underside of the back end of a ski 310. To further accommodate skis with fins, the rack may be spaced a distance from the interior wall of the boat and/or the interior wall of the boat may include one or more recesses for receiving the fins. Preferably, corresponding pairs of arms 221, 223 and 222, 224 are spaced about 26 inches to about 48 inches apart, more preferably about 28 inches to about 40 inches apart, and most preferably about 30 inches apart.

Figure 12:
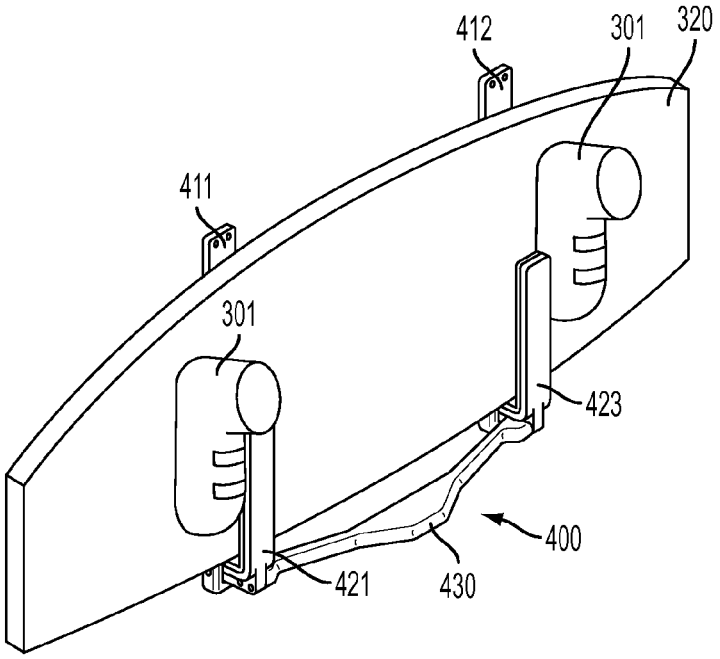
FIG. 12 shows an alternate embodiment of a rack holding a wakeboard.

In an alternate embodiment such as shown in FIG. 12, a rack 400 may be configured to hold a wakeboard 320 between the substantially upright surfaces 411, 412 and the arms 421, 423. Like rack 200, rack 400 includes a pedal 430 to open the arms when depressed. In the embodiment shown in FIG. 12, corresponding pairs of arms 421, 423 are placed between the boots 301. The boots 301 on wakeboards typically have adjustable locations, but usually are not closer than 12 inches apart. Corresponding pairs of arms 421, 423 may be positioned so that the outside edges of the arms are no greater than about 12 inches in order to fit between the boots, and more preferably about 9 inches. Alternatively, the arms may be positioned with respect to the boots in the same manner as described above for water skis, i.e., with the boots located between the arms. In another alternate embodiment, a single arm may be used to hold a piece of water sports equipment. When one arm is used to hold a piece of water sports equipment, it is preferable that the arm be widened to about 1½ inches or greater to balance the piece of water sports equipment in the rack.

The length of the vertical portion of the arm is preferably long enough to extend just above the center of the width of the piece of water sports equipment that the rack is designed to hold. For a water ski, the length of the vertical portion of the arm is preferably between about 3 inches to about 6 inches and more preferably between about 4 inches to about 5 inches. For a wakeboard, the length of the vertical portion of the arm is preferably between about 6 inches to about 12 inches and more preferably between about 8 inches to about 9 inches. For a surfboard, the length of the vertical portion of the arm is preferably between about 8 inches to about 15 inches and more preferably between about 10 inches to about 12 inches.

To impart optimal securing force to the piece of water sports equipment, the vertical portion of the arm is preferably parallel to the substantially upright surface when the piece of water sports equipment is in the rack. When the rack is designed to hold a water ski, the distance between the substantially upright surface and the vertical portion of the arm is preferably between about ¾ inch to about 1½ inches and more preferably about ⅞ inch. When the rack is designed to hold a wakeboard, the distance between the substantially upright surface and the vertical portion of the arm is preferably between about ¾ inch to about 1½ inches and more preferably about 1 inch. When the rack is designed to hold a surfboard, the distance between the substantially upright surface and the vertical portion of the arm is preferably between about 1½ inches to about 2½ inches and more preferably about 2 inches.

In the preferred embodiment, corresponding pairs of arms 221, 223 and 222, 224 are located at approximately the same height above the floor 121. The top pair of arms 222, 224 is preferably positioned far enough above the bottom pair of arms 221, 223 to accommodate the width of the piece of water sports equipment held in the bottom pair of arms 221, 223 and allow for easy insertion and removal of the equipment. When the rack is designed to hold a water ski in the bottom pair of arms 221, 223, the top pair of arms 222, 224 is preferably about 7½ inches to about 10 inches above the bottom pair of arms 221, 223 and more preferably about 8 inches above the bottom pair of arms 221, 223. When the rack is designed to hold a wakeboard in the bottom pair of arms 221, 223, the top pair of arms 222, 224 is preferably at least about 18½ inches above the bottom pair of arms 221, 223. When the rack is designed to hold a surfboard in the bottom pair of arms 221, 223, the top pair of arms 222, 224 is preferably at least about 22 inches above the bottom pair of arms 221, 223. Those of ordinary skill in the art will recognize that the rack is not limited to two corresponding pairs of arms. For example, the rack 400 shown in FIG. 12 has a single corresponding pair of arms 421, 423. Alternatively, three or more corresponding pairs of arms can be used. Or, as mentioned above, the rack may include just a single arm.

Figure 7:
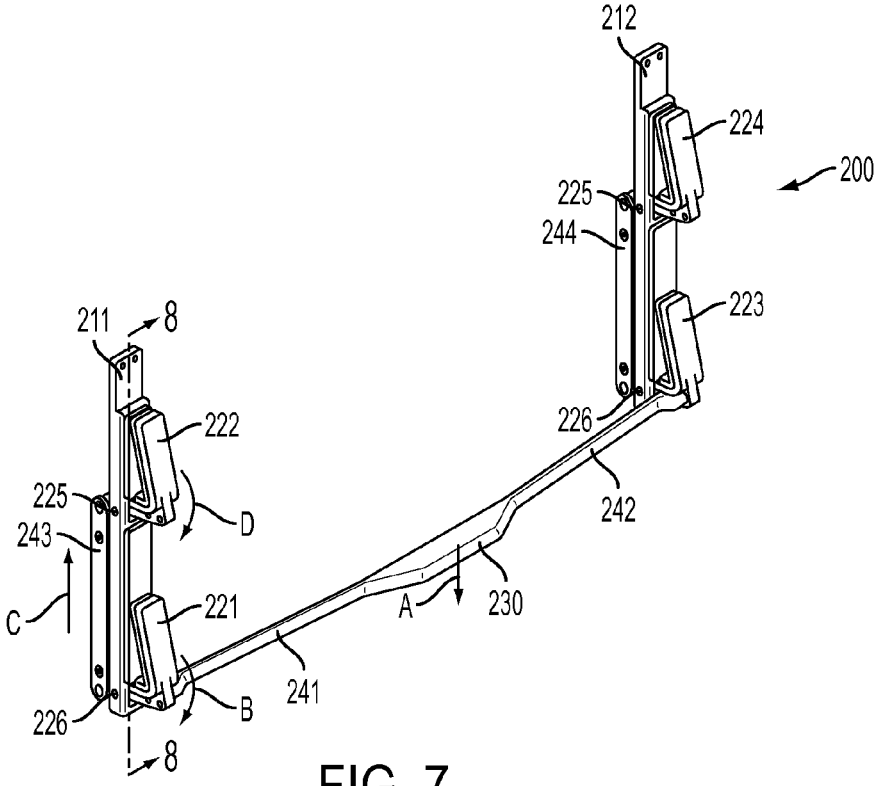
FIG. 7 shows the rack of FIG. 4 in a closed position, with arrows indicating how certain components of the rack move when opening the rack.
Figure 8:
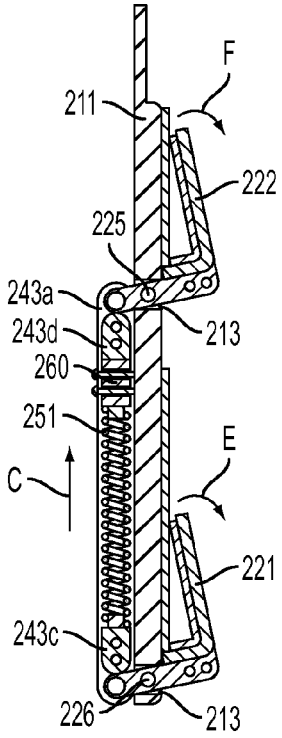
FIG. 8 is a cross-sectional view of a portion of the rack shown in FIG. 7, with arrows indicating how certain components of the rack move when opening the rack.

In the preferred embodiment shown in FIG. 4, the pedal 230 is positioned approximately midway between the two substantially upright surfaces 211, 212. The pedal 230 is positioned and configured to be operated by a human foot. As discussed further below, the pedal 230 can be depressed by a human foot to move the arms 221, 222, 223, 224 away from the substantially upright surfaces 211, 212. The pedal 230 preferably travels between about 1½ inches to about 2 inches when depressed. The pedal 230 is movable between a closed position and an open position. In the preferred embodiment, the closed position is the position of the pedal 230 when the arms 221, 222, 223, 224 are contacting either the substantially upright surfaces 211, 212, as shown in FIGS. 7 and 8, or a piece of water sports equipment, as shown in FIGS. 3 and 12.

In the preferred embodiment shown in FIGS. 4-6, the rack has linkages 241, 242, 243, 244 between the pedal 230 and the arms 221, 222, 223, 224. The linkages 241, 242, 243, 244 are configured to move the arms 221, 222, 223, 224 away from the substantially upright surfaces 211, 212 when the pedal 230 is depressed. In the preferred embodiment, the linkages 241, 242, 243, 244 are mechanical linkages. As shown in FIG. 4, linkages 241 and 242 extend from the pedal in opposite directions and have a slight upwards angle. Linkage 241 is attached to one bottom arm 221 and linkage 242 is attached to the other bottom arm 223. Behind each substantially upright surface is another linkage 243, 244 connected to the lower ends of each L-shaped arm. (In the following description reference will be made to linkage 243 as shown in FIG. 6, but the description applies to linkage 244 as well.) Linkage 243 comprises two narrow plates 243*a*, 243*b* and two spacers 243*c*, 243*d*. One end of each plate 243*a*, 243*b* is pivotably attached to the lower end of the bottom arm 221. The other end of each plate 243*a*, 243*b* is pivotably attached to the lower end of the top arm 222.

In the embodiment just described, the linkages 241, 242, 243, 244 are each individually referred to as a linkage. However, multiple, directly or indirectly interconnected linkages may also be considered a single linkage. In addition, the pedal, linkage(s), and arm(s) may be separately or integrally formed.

Those skilled in the art will recognize that the linkages are not limited to the specific configurations described above and may include other configurations comprising plates, bars, rods, wire, cables, and the like. Those skilled in the art will also recognize that the linkages need not be mechanical linkages, and may include electrical linkages, hydraulic linkages, pneumatic linkages, and the like. For example, the pedal may operate a switch that controls an electric motor that actuates each arm. In some embodiments, for example, where the pedal is connected directly to an arm, there need not be any linkage at all.

Figure 14:
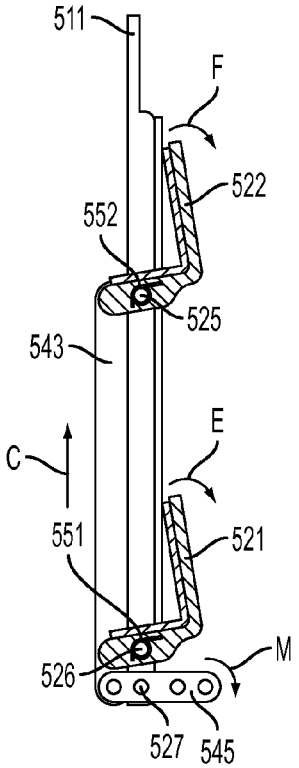
FIG. 14 is a cross-sectional view of a portion of the rack shown in FIG. 13, with arrows indicating how certain components of the rack move when opening the rack.
Figure 16:
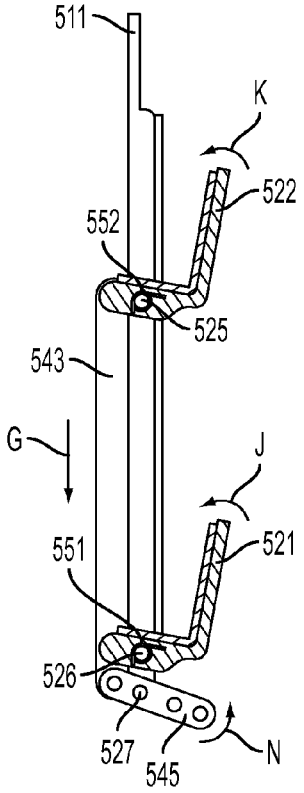
FIG. 16 is a cross-sectional view of a portion of the rack shown in FIG. 15, with arrows indicating how certain components of the rack move when closing the rack.

A force is used to bias each arm 221, 222, 223, 224 toward the substantially upright surfaces 211, 212. In the preferred embodiment, this biasing force also imparts a securing force to hold the piece of water sports equipment in the rack. In the preferred embodiment, the biasing force is imparted by compression springs 251 located behind each substantially upright surface. As shown in FIG. 6, compression spring 251 is positioned behind the substantially upright surface 211 and between the two plates 243*a*, 243*b*. One end of the compression spring is attached to the spacer 243*c*. The other end of the compression spring is attached to a spring stop 260. The spring stop 260 is secured to the substantially upright surface 211. The biasing force is preferably sufficient to prevent the arms 221, 222, 223, 224 from accidentally opening during normal operation of the boat 100. In the preferred embodiment, the total force imparted by the two compression springs is about 25 pounds-force. Those skilled in the art will recognize that other types of springs may be used to bias the arms toward the substantially upright surfaces including, for example, a torsion spring (551, 552 as shown in FIGS. 14 and 16) or a tension spring. Those skilled in the art will also recognize that the arms may be biased toward the substantially upright surfaces by other suitable means, for example, a pneumatic cylinder.

Figure 9:
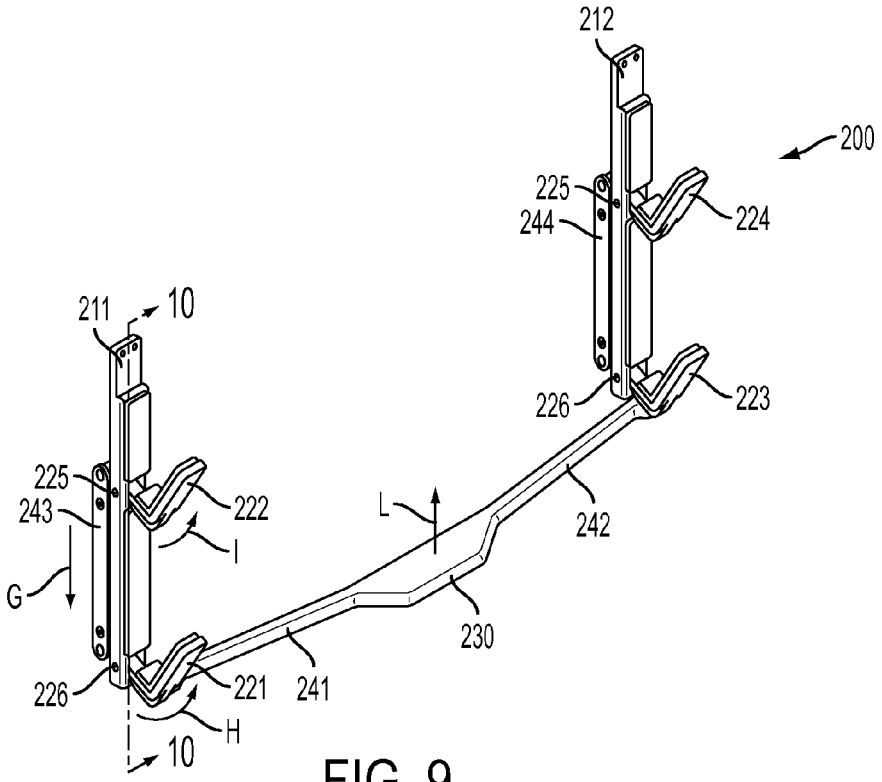
FIG. 9 shows the rack of FIG. 4 in an open position, with arrows indicating how certain components of the rack move when closing the rack.
Figure 10:
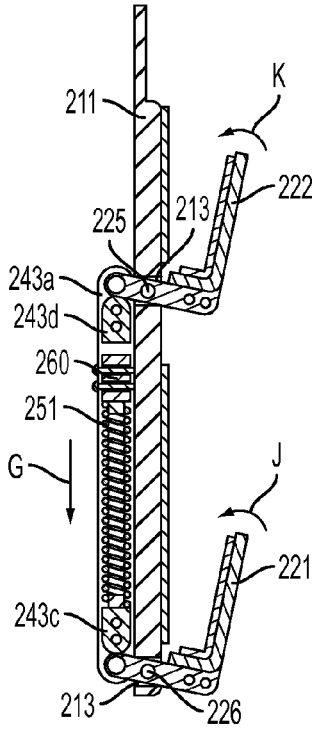
FIG. 10 is a cross-sectional view of a portion of the rack shown in FIG. 9, with arrows indicating how certain components of the rack move when closing the rack.

FIGS. 7-10 show the operation of the preferred embodiment of the rack 200. Specifically, FIGS. 7 and 8 show an opening operation and FIGS. 9 and 10 show a closing operation. The arms 221, 222, 223, 224 are opened by a person pressing his or her foot down on the pedal 230 in direction A to move the pedal from the closed position to the open position. Linkages 241, 242 cause the bottom arms 221, 223 to rotated in direction B about their respective pivotable connections 226. As the bottom arms 221, 223 rotate in direction B, the lower end of each arm 221, 223 moves in direction C. Linkages 243, 244 attached to the lower ends of the bottom arms 221, 223 then cause the lower end of each top arm 222, 224 to also move in direction C. As a result, the top arms 222, 224 pivot about their respective pivotable connections 225 in direction D. As each of the arms 221, 222, 223, 224 pivots about its respective pivotable connection 225, 226, the arms 221, 222, 223, 224 move away from the substantially upright surfaces 211, 212 in directions E and F. As linkages 243, 244 move in direction C, the compression springs 251 are compressed between the spacer 243*c* and the spring stop 260. FIG. 10 shows compression spring 251 in the compressed state. Once in the open position as shown in FIGS. 9 and 10, the person is able to insert a piece of water sports equipment into the rack 200 or remove a piece of water sports equipment from the rack 200.

As shown in FIGS. 9 and 10, when the person releases his or her foot from the pedal 230, the compressed springs 251 move the linkages 243, 244 in direction G. As a result, the lower end of each arm 221, 222, 223, 224 also moves in direction G. Each arm 221, 222, 223, 224 thus pivots about its respective pivotable connection 225, 226 in directions H and I, causing the arms 221, 222, 223, 224 to move toward the substantially upright surfaces 211, 212 in directions J and K. Additionally, the linkages 241 and 242 move the pedal 230 in direction L to the closed position. If a piece of water sports equipment is in the rack, the spring force will hold the piece of water sports equipment in the rack as shown in FIGS. 3 and 12.

An alternate embodiment of a rack 500 is shown in FIGS. 13-16. Similar to the rack of the preferred embodiment 200, the alternate embodiment of the rack 500 includes substantially upright surfaces 511, 512, arms 521, 522, 523, 524, a pedal 530, and linkages 541, 542, 543, 544, 545, 546. Additionally, the rack may include springs 551, 552 for biasing the arms toward the substantially upright surfaces 511, 512. In this embodiment, the springs 551, 552 are torsion springs positioned in each arm 521, 522, 523, 524 about a pivotable connection 525, 526. Although not depicted, those skilled in the art will recognize that arms 523, 524 may each contain a torsion spring positioned similarly to torsion springs 551 and 552. The rack 500 is configured to hold a piece of water sports equipment between each arm and its respective, opposing substantially upright surface. As shown, the alternate embodiment of the rack 500 is configured to hold a pair of water skis. In this embodiment, the arms 521, 522, 523, 524 oppose the substantially upright surfaces 511, 512, but unlike in the rack 200 of the previous embodiment, the arms 521, 522, 523, 524 are attached to one side of each substantially upright surface 511, 512. As used herein, the term "opposed" does not require the arm and the substantially vertical surface to be in line with each other, as they are in rack 200.

Figure 13:
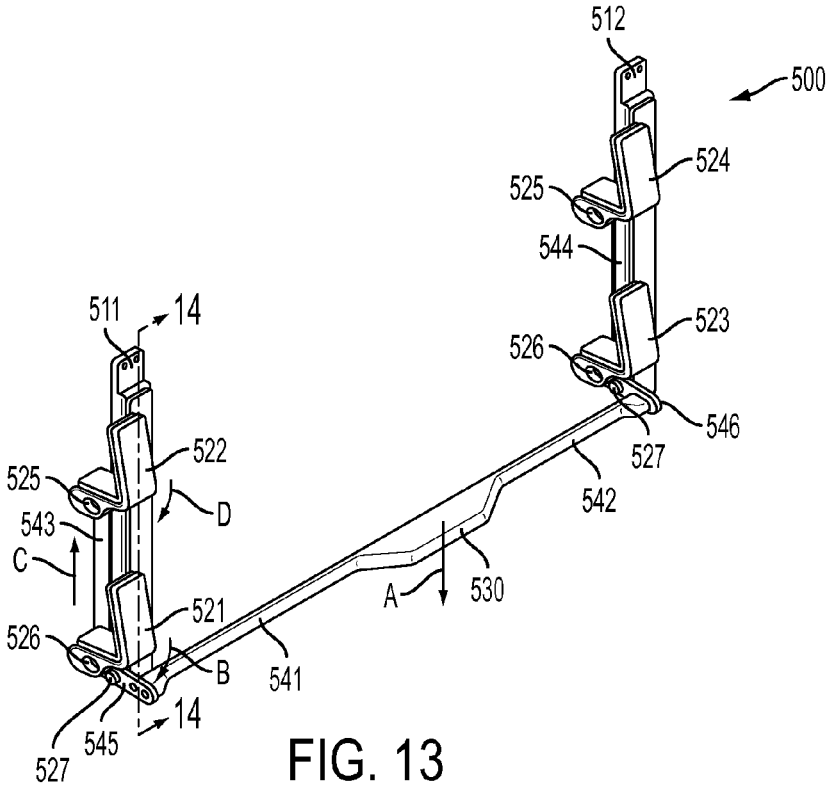
FIG. 13 shows another alternate embodiment of a rack in a closed position, with arrows indicating how certain components of the rack move when opening the rack.
Figure 15:
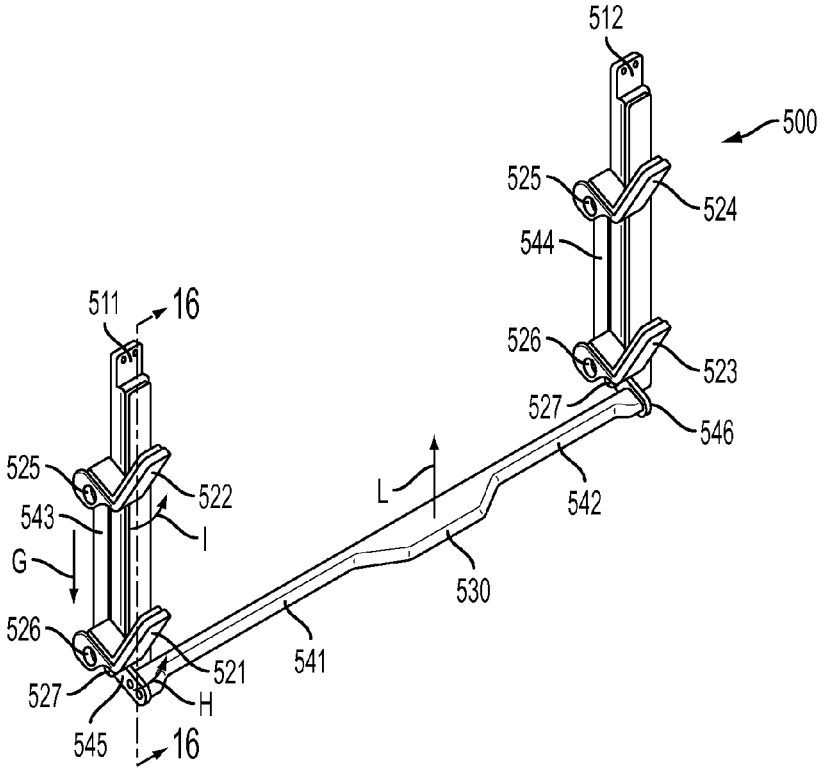
FIG. 15 shows the rack of FIG. 13 in an open position, with arrows indicating how certain components of the rack move when closing the rack.

The alternate embodiment of the rack 500 shown in FIGS. 13-16 operates similarly to the preferred embodiment of the rack 200 described above. FIGS. 13 and 14 show an opening operation and FIGS. 15 and 16 show a closing operation. The arms 521, 522, 523, 524 are opened by a person pressing his or her foot down on the pedal 530 in direction A to move the pedal from the closed position to the open position. Linkage 541 is connected to the front end of linkage 545, and linkage 542 is connected to the front end of linkage 546. As the pedal 530 moves in direction A, linkages 541 and 542 cause linkages 545 and 546 to pivot about their respective pivotable connections 527 to the substantially vertical surfaces 511, 512 in direction M. As a result, the back ends of linkages 545 and 546 move in direction C. Linkage 543 is attached to the back end of linkage 545 and the lower end of arms 521 and 522. As the back end of linkage 545 moves in direction C, linkage 543 and the lower end of arms 521 and 522 also move in direction C and result in the arms 521, 522 opening as described above with respect to the preferred embodiment. Likewise, linkage 544 is attached to the back end of linkage 546 and the lower end of arms 523 and 524. As the back end of linkage 546 moves in direction C, linkage 544 and the lower end of arms 523 and 524 also move in direction C and result in the arms 523, 524 opening as described above with respect to the preferred embodiment.

As each arm 521, 522, 523, 524 pivots about its respective pivotable connection 525, 526 in the opening operation, the torsion springs 551, 552 are compressed as shown in FIG. 16. When the person removes his or her foot from the pedal 530, the torsion springs cause the arms 521, 522, 523, 524 to pivot about their respective pivotable connections 525, 526 in directions H and I. The arms 521, 522, 523, 524 then move toward the substantially upright surfaces 511, 512 in directions J and K. Also as a result of the arms 521, 522, 523, 524 pivoting about their respective pivotable connections 525, 526, linkages 543 and 544 move in direction G which results in linkages 545 and 546 pivoting about the pivotable connection 527 in direction N and the pedal 530 moving in direction L to the closed position. If a piece of water sports equipment is in the rack, the spring force will hold the piece of water sports equipment in the rack.

The embodiments discussed herein are examples of preferred embodiments of the present invention and are provided for illustrative purposes only. They are not intended to limit the scope of the invention. Although specific configurations, structures, materials, etc. have been shown and described, such are not limiting. Modifications and variations are contemplated within the scope of the invention, which is to be limited only by the scope of the accompanying claims.

What is claimed is:

1. A rack for holding water sports equipment, the rack comprising:

a substantially upright surface suitable for mounting along an interior wall of a boat;

an arm opposing the substantially upright surface for holding a piece of water sports equipment between the arm and the substantially upright surface, the arm being movable away from the substantially upright surface, against a force biasing the arm toward the substantially upright surface, in order to allow the piece of water sports equipment to be inserted or removed from between the arm and the substantially vertical surface; and a pedal movable between a closed position and an open position, the pedal being moveable from the closed position to the open position by a force applied by a human foot and returnable to the closed position when that force is removed, the pedal being directly or indirectly connected to the arm in order to move the arm away from the substantially upright surface when the pedal is moved from the closed position to the open position.

2. The rack of claim 1, further comprising a linkage between the pedal and the arm for moving the arm away from the substantially upright surface when the pedal is moved from the closed position to the open position.

3. The rack of claim 2, further comprising a spring for biasing the arm toward the substantially upright surface.

4. The rack of claim 3, wherein the spring is a compression spring.

5. The rack of claim 1, wherein each of the substantially upright surface and the arm includes padding to protect the water sports equipment from damage.

6. The rack of claim 2, wherein the arm is substantially L-shaped.

7. The rack of claim 6, wherein the linkage is connected to the arm near one end of the L shape.

8. The rack of claim 7, wherein, at a position adjacent to where the arm is connected to the linkage, the arm is pivotably connected to either the substantially upright surface or a member that is fixed relative to the substantially upright surface.

9. The rack of claim 2, wherein the linkage comprises at least one of a plate, a bar, and a rod.

10. The rack of claim 2, further comprising a second arm.

11. The rack of claim 10, wherein the second arm (i) is provided either above or below the first arm, (ii) opposes the substantially upright surface, (iii) is for holding a second piece of water sports equipment between the second arm and the substantially upright surface, and (iv) is movable away from the substantially upright surface, against a force biasing the second arm toward the substantially upright surface, in order to allow the second piece of water sports equipment to be inserted or removed from between the second arm and the substantially upright surface.

12. The rack of claim 11, wherein the linkage is provided between the pedal and each of the first and second arms for moving each of the first and second arms away from the substantially upright surface when the pedal is moved from the closed position to the open position.

13. The rack of claim 12, further comprising a single spring for biasing both the first arm and the second arm toward the substantially upright surface.

14. The rack of claim 10, wherein the second arm (i) is provided at the same height as, and spaced apart from, the first arm, (ii) opposes a second substantially upright surface, (iii) is for holding the piece of water sports equipment between the second arm and the second substantially upright surface, and (iv) is movable away from the second substantially upright surface, against a force biasing the arm toward the substantially upright surface, in order to allow the piece of water sports equipment to be inserted or removed from between the second arm and the second substantially upright surface.

15. The rack of claim 14, wherein a second linkage is provided between the pedal and the second arm for moving the second arm away from the second substantially upright surface when the pedal is moved from the closed position to the open position.

16. The rack of claim 15, further comprising a pair of springs, wherein one spring biases the first arm toward the first substantially upright surface and another spring biases the second arm toward the second substantially upright surface.

17. A boat comprising:

a hull including a bow, a stern, and starboard and port sides; and a rack for holding water sports equipment, the rack being mounted along an interior wall of the boat and including:

a substantially upright surface;

an arm opposing the substantially upright surface for holding a piece of water sports equipment between the arm and the substantially upright surface, the arm being movable away from the substantially upright surface, against a force biasing the arm toward the substantially upright surface, in order to allow the piece of water sports equipment to be inserted or removed from between the arm and the substantially upright surface; and a pedal movable between a closed position and an open position, the pedal being moveable from the closed position to the open position by a force applied by a human foot and returnable to the closed position when that force is removed, the pedal being directly or indirectly connected to the arm in order to move the arm away from the substantially upright surface when the pedal is moved from the closed position to the open position.

18. The boat of claim 17, wherein the rack further includes a linkage between the pedal and the arm for moving the arm away from the substantially upright surface when the pedal is moved from the closed position to the open position.

19. The boat of claim 18, wherein the rack further includes a spring for biasing the arm toward the substantially upright surface.

20. The boat of claim 19, wherein the spring is a compression spring.

21. The boat of claim 17, wherein the boat is capable of being used for water skiing, and the rack is dimensioned to hold at least one pair of water skis.

22. The boat of claim 17, wherein the boat is capable of being used for wakeboarding, and the rack is dimensioned to hold at least one wakeboard.

23. The boat of claim 17, wherein the boat is capable of being used for wakesurfing, and the rack is dimensioned to hold at least one surfboard.

* * * * *